US012690724B2

(12) United States Patent
Cristofoli et al.

(10) Patent No.: US 12,690,724 B2
(45) Date of Patent: Jul. 28, 2026

(54) SHOWER PAN APPARATUS

(71) Applicant: Venosa, LLC, Louisville, KY (US)

(72) Inventors: John Cristofoli, Anchorage, KY (US); Louis Cristofoli, Louisville, KY (US); Maria Shore, Louisville, KY (US); Anna Tatman, Louisville, KY (US)

(73) Assignee: Venosa, LLC, Louisville, KY (US)

( * ) Notice: Subject to any disclaimer, the term of this patent is extended or adjusted under 35 U.S.C. 154(b) by 264 days.

(21) Appl. No.: 18/156,677

(22) Filed: Jan. 19, 2023

(65) Prior Publication Data

US 2024/0245267 A1 Jul. 25, 2024

(51) Int. Cl.

| | |
|---|---|
| ***A47K 3/40*** | (2006.01) |
| ***E04C 2/04*** | (2006.01) |
| ***E04C 2/10*** | (2006.01) |

(52) U.S. Cl.

CPC ..... *A47K 3/405* (2013.01); *E04C 2/04* (2013.01); *E04C 2/10* (2013.01)

(58) Field of Classification Search

CPC ..... A47K 3/40–405; E04F 15/12–147

See application file for complete search history.

(56) References Cited

U.S. PATENT DOCUMENTS

| | | | | |
|---|---|---|---|---|
| 10,334,993 | B1 * | 7/2019 | Nastasi | E04F 15/02188 |
| 10,710,335 | B2 * | 7/2020 | Wedi | B32B 5/28 |
| 11,406,228 | B2 * | 8/2022 | Cook | E03C 1/0408 |
| 2007/0157538 | A1 * | 7/2007 | DeGarmo | A47K 3/40 52/608 |
| 2013/0025044 | A1 * | 1/2013 | Moyer | A47K 3/284 4/614 |
| 2014/0230140 | A1 * | 8/2014 | Davis, Jr. | A47K 3/40 29/525.01 |
| 2015/0151456 | A1 * | 6/2015 | Crawley | B28B 13/028 264/219 |
| 2022/0325530 | A1 * | 10/2022 | Peñaloza | B32B 5/02 |

OTHER PUBLICATIONS

Resuflor Terrazzo TG Guide Spec, Sherwin-Williams. Jul. 25, 2021. <https://industrial.sherwin-williams.com/na/us/en/resin-flooring/catalog/product/products-by-industry.15274955/resuflor-terrazzo-tg.12322109.html> (Year: 2021).*

Canadian Patent Application No. 3226328 filed Jan. 17, 2024 titled Shower Pan Apparatus.

* cited by examiner

*Primary Examiner* — Nicholas A Ros

(74) *Attorney, Agent, or Firm* — Dinsmore & Shohl LLP

(57) ABSTRACT

Described is a system and apparatus for a precast terrazzo shower including a floor portion, an interior curb, and a wedge portion. Each component may be precast in a size suitable for a standard shower installation.

6 Claims, 6 Drawing Sheets

SHOWER PAN APPARATUS

BACKGROUND OF THE INVENTION

Field of the Invention

The embodiments described herein relate generally to a system and apparatus for providing a fabricated shower pan system and more particularly to a pre-cast and sized terrazzo shower pan and curb system that is readily installed in new, renovation or turnkey construction applications. The system and apparatus provides an easily transported shower pan system, having a minimum of component parts, that may be quickly assembled and installed in a a plurality of shower applications with a minimum of cutting and resizing. Furthermore, in some embodiments the system provides perfectly matched and sized terrazzo components without the need for additional cutting, fitting, and resizing prior to installation.

Description of the Related Art

In new or remodel bathroom construction homeowners and contractors often entirely remove existing bathroom tubs and showers and install new shower systems once the area is prepared for installation, for example by providing the necessary shower pan and wall installation.

In many existing shower systems a plurality of walls, for example a front and back wall and a side wall, are constructed from cement backer board or a similar substrate. Similarly, a substrate floor is also provided, with a drain installed at an end thereof as is known in the art. Once this basic configuration of shower "substrate" is in place a wide variety of existing shower systems may be installed.

For example, many fiberglass or plastic showers are widely available that are pre-formed and essentially dropped into place. As is well known, these fiberglass or plastic systems are quite functional, but aesthetically substandard. Accordingly, many shower installations involve installing ceramic or porcelain tiles, or natural stone tiles, over the entire shower surface. However, installation and sealing of the many tiles and grout joints inherent to tile showers require a great deal of labor to install and seal, and are therefore relatively expensive and time consuming. Furthermore, most tiled shower installations require a great deal of cutting and fitting of tiles prior to installation and thus are relatively inefficient to install. While tiling of shower walls is relatively straightforward, floor tiling is often quite labor and time intensive, since floors require fitting and tiling up to drain edges, tiling curbs, providing proper sloping for drainage, and precise grouting and sealing so no leaks occur.

Accordingly, there is a need in the art for a system and method of providing a shower pan system, including a floor and curb, that is easy to install, requires minimal pieces or components, and minimizes joints and points of failure.

SUMMARY OF THE INVENTION

The present disclosure is related to systems and apparatus for a precast shower pan system that includes a shower floor pan, a curb, and a wedge or trim piece. In some embodiments a shower installation will typically require an installer to tile a floor, curb, and various trim pieces to install the floor. The system described provides a single-piece precast floor that is sized to a specific application to fit the installation precisely with minimal cutting or resizing.

In various embodiments and accordance with some aspects the precast shower floor is comprised of terrazzo material. The terrazzo may include a plurality of different marble sizes bound with an epoxy resin or similar curable material that is also relatively waterproof. The precast floor may be formed in a mold that is sized to fit a predetermined floor size. Alternatively, a larger precast floor slab may be formed in a mold and subsequently cut to various sizes prior to leaving the manufacturing facility or even at a construction site in order to accommodate a variety of shower floor installation sizes.

In some embodiments the system and apparatus disclosed herein provides a curb, for example a precast terrazzo curb, that includes two sides that meet at an interior angle. The curb can be shaped and sized to closely fit and cover an existing shower curb, thereby providing an identical look to the shower floor. Similarly, a wedge or trim piece may be provided that is sized and shaped to cover an interior wall of the existing shower curb. Taken together, the shower floor, curb, and trim piece form a turnkey shower floor system that is easily and readily installed by application of conventional polymer mortar, and requires little to no fitting or cutting.

In other embodiments and aspects the shower pan system may be comprised of a natural stone material such as marble or even porcelain that is combined with a polymer resin to produce the components of the pan system. In some embodiments the terrazzo material may be comprised of size 0, size 1 and size 2 marble, or a plurality of other sizes, mixed with a polymer resin.

As used herein for purposes of the present disclosure, the term "shower pan system" should be understood to be generally synonymous with and include at least a shower floor having a predetermined size to fit a specific existing shower floor substrate and/or a shower substrate with an installed drain. "Shower pan system" can further include a curb and at least one trim piece, each of which are also sized to fit an existing shower curb.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

Other features, objects and advantages of the present invention will become apparent from the detailed description of the drawing Figures taken in conjunction with the appended drawing Figures.

BRIEF DESCRIPTION OF THE DRAWING FIGURES

In the drawings, like reference characters generally refer to the same parts throughout the different views. Also, the drawings are not necessarily to scale, emphasis instead generally being placed upon illustrating the principles of the invention.

DETAILED DESCRIPTION OF THE PREFERRED EMBODIMENT(S)

Figure 1:
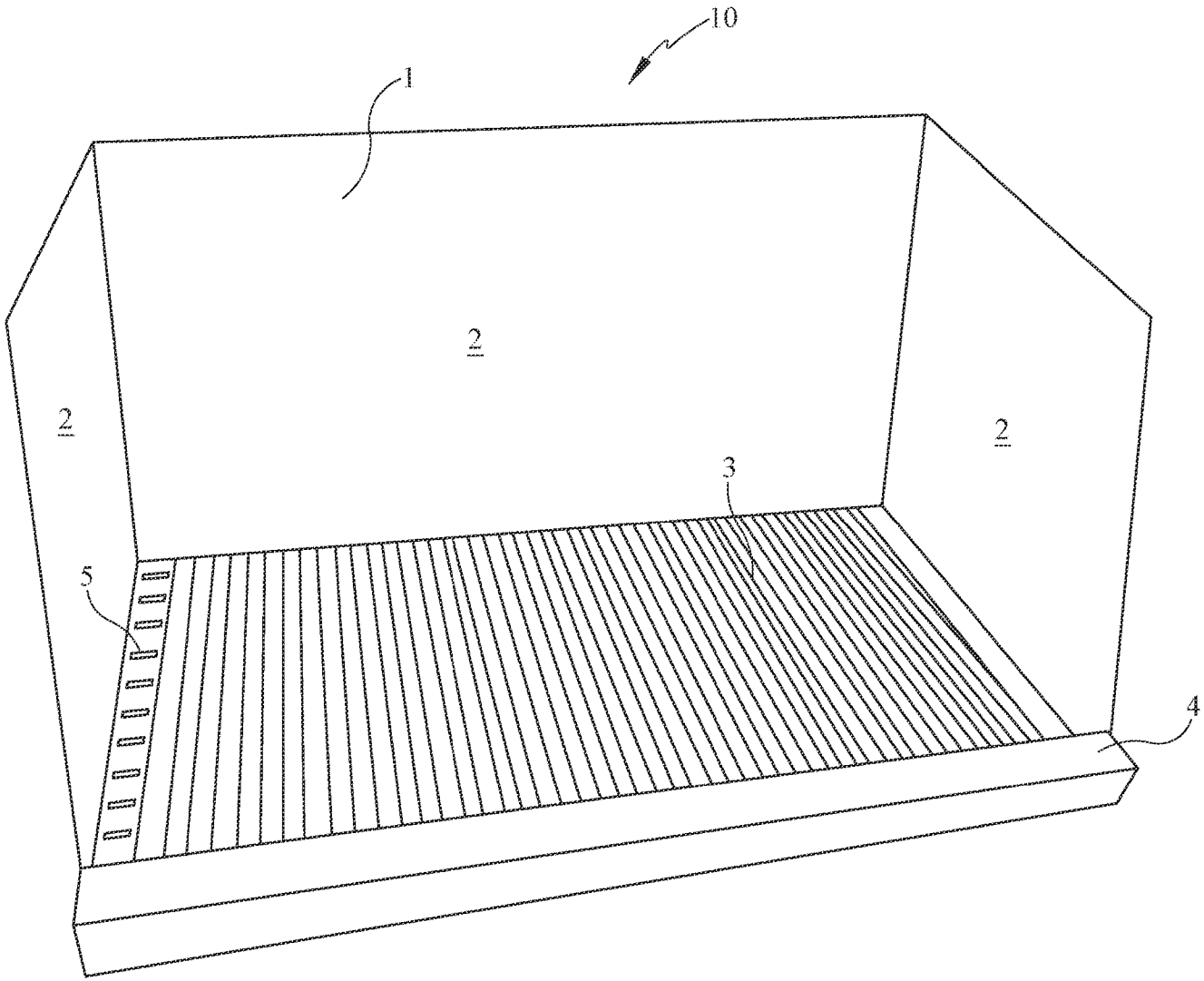
FIG. 1 is a perspective view of a shower pan system in accordance with one embodiment of the present invention.
Figure 2:
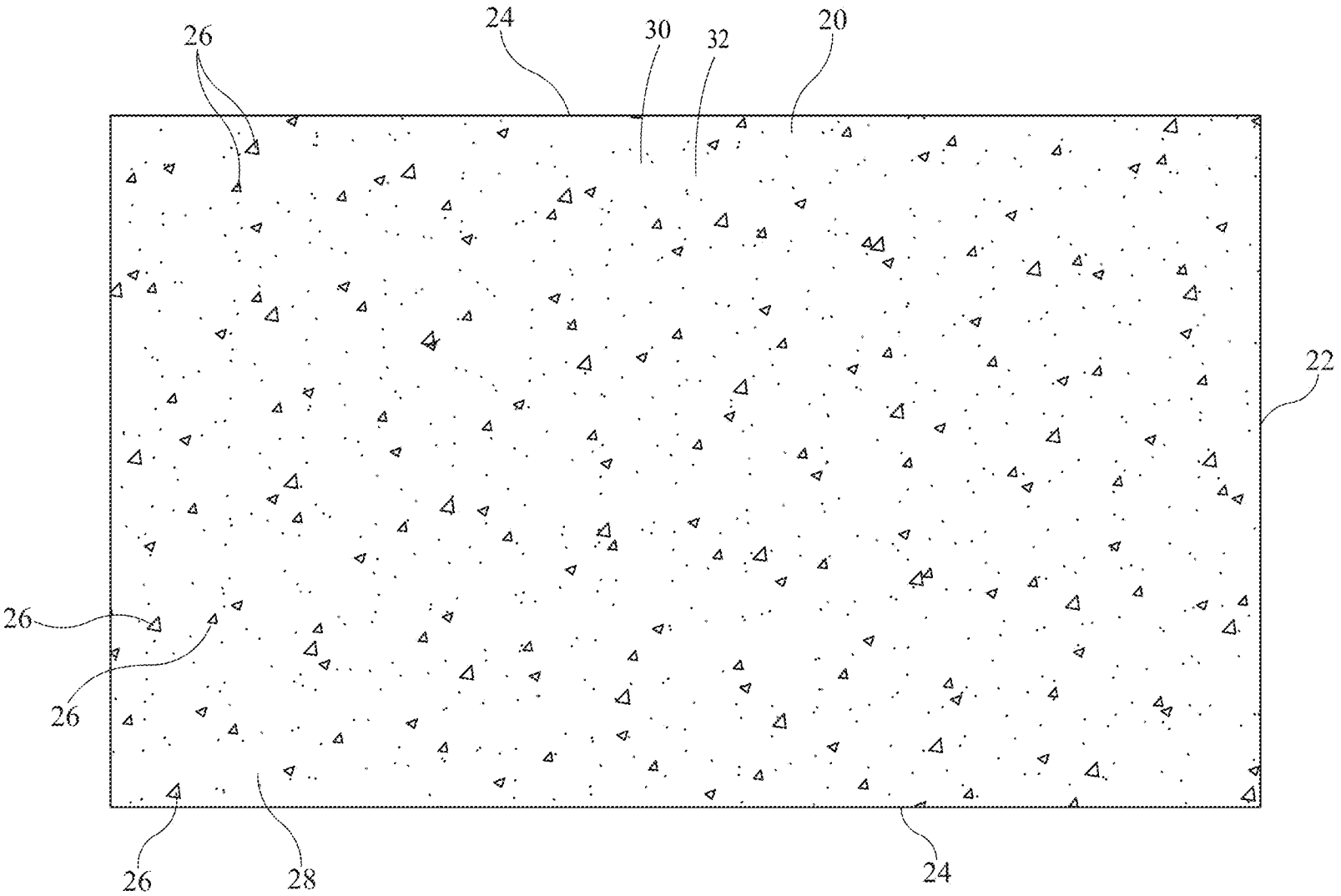
FIG. 2 is a top view of a terrazzo shower pan in accordance with one embodiment of the present invention.

Numerous variations and modifications will be apparent to one of ordinary skill in the art, as will become apparent from the description below. Therefore, the invention is not limited to the specific implementations discussed herein.

Referring now to drawing FIGS. 1-8, and in accordance with some aspects and embodiments, the system and apparatus 10 described herein overcomes the aforementioned inherent problems in the prior art by providing a shower pan system and apparatus 10, that is intended to be used and installed in an existing shower 1. Shower 1 may include a plurality of conventional shower walls 2, as well as a shower floor 3 and an substrate curb 4 or similar barrier to prevent water from flowing away from shower floor 3 and direct it toward a drain 5. In some embodiments as depicted in the drawing Figures drain 5 may be a linear trough drain, but any type of drain 5 may be employed with the apparatus 10 described.

In many applications shower floor 3 and substrate curb 4 are comprised of cement board or a similar solid substrate material suitable for supporting and securing shower pan system 10. In some embodiments shower floor 3 and curb 4 may be comprised of a commercially available foam material that is readily adhered to the floor of shower 10. Furthermore, in some applications a waterproof membrane may be employed over floor 3 and curb 4. It should be noted that floor 3 substrate, curb 4 substrate, and drain 5 may come in a variety of materials, shapes, and sizes without departing from the scope of the disclosed embodiments of apparatus 10.

As shown best in FIGS. 2, 3 and 6-8, for example, a shower pan 20 includes opposed ends 22 and opposed sides 24 and, as depicted, is generally rectangular in shape and sized to cover a substantial portion of shower floor 3. In various embodiments shower pan 20 is formed of a precast terrazzo material comprised of an aggregate material, for example marble 26 aggregate of various sizes, and an epoxy resin 28, thereby providing a waterproof and aesthetically pleasing shower floor 3. In some embodiments shower pans 20 may be precast in specific sizes and shape to accommodate a variety of shower floor 3 sizes and shapes, thereby providing a quick and simple pan 20 installation for installers. Furthermore, shower pan 20 may be generally planar, or flat, regardless of the shape of ends 22 and sides 24 to provide for even drainage of water from shower 1.

In some aspects and embodiments the system and apparatus 10 described herein may also include a shower pan 20 comprised of a mixture of a plurality of marble 26 piece sizes and epoxy resin 28. In some exemplary but non-limiting embodiments marble 26 pieces of size 0, size 1, and size 2 may be mixed with epoxy resin 28 to form precast shower pan 20. In these embodiments, marble 26 aggregate is mixed with resin 28 and subsequently poured into a mold (not shown) having a predetermined size and shape for a given shower floor 3 size. Once resin 28 hardens, the finished precast shower pan 20 is then removed from the mold, ground to a smooth finish, is grouted, honed and sealed with a suitable waterproof sealant, and is ready to install.

In some embodiments a shower pan 20 may comprise marble 26 pieces having a composition of 20% size 0, 40% size 1, and 40% size 2. In some other aspects the terrazzo can comprise 20% size 0 and 80% size 1 marble, pieces, or many other combinations, typically modified in increments of 5%. In some embodiments the terrazzo may be 80% by volume of size 0 and size 1 and 20% by volume of size 2. Furthermore, in some embodiments epoxy resin 28 may be mixed with ATF (aggregate, terrazzo and filler) 20 filler 30 and epoxy resin hardener 32 to provide additional visual depth and appeal to shower pan 20 as well as hasten the curing process for pan 20. In some embodiments ATF filler 30 may comprise a natural calcite material, for example a combination of calcium carbonate and magnesium carbonate having a specific gravity of approximately 2.7 and a dry brightness value (Hunter Y) of 82. Marble fines, for example of size 0000 may also be used as a filler material. ATF filler provides density and acts as a thickener to the epoxy resin thereby making it easier to pour and form shower pan 20. In some aspects and embodiments the total volume of marble or other aggregate used to form shower pan 20 is approximately eighty percent (80%) while the volume of ATF filler 30 and epoxy resin and hardener is approximately twenty percent (20%).

Furthermore, it will be understood that a variety of mold sizes and shapes may be used to form precast shower pans 20 without departing from the scope of the embodiments disclosed. I some embodiments a generally planar sheet of terrazzo may be produced and subsequently cut to size or shape as required to construct a shower pan 20 for a specific application. In some embodiments shower pan 20 is a single-piece pan, thereby requiring a minimum number of joints to seal and/or grout.

Figure 4:
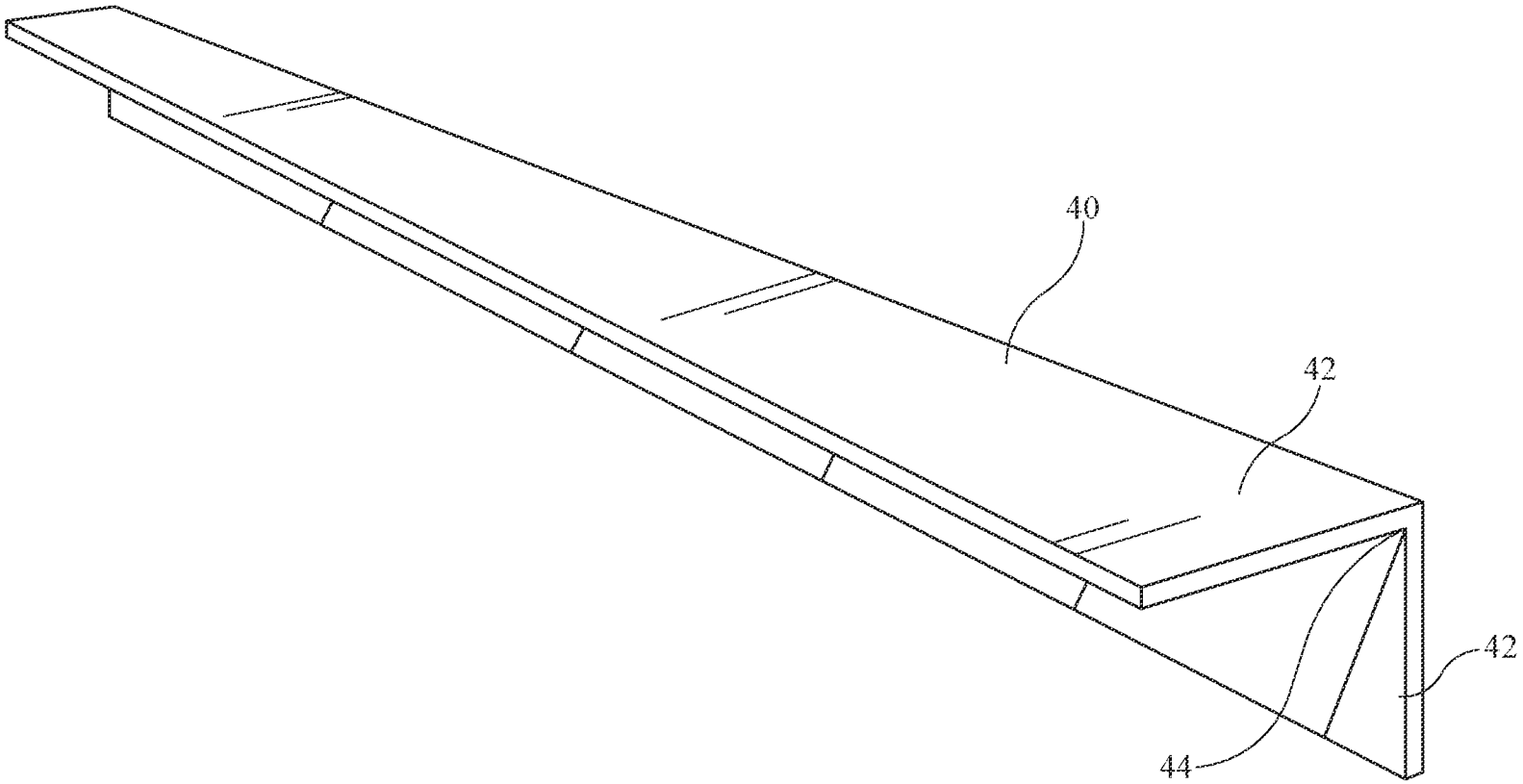
FIG. 4 is a perspective view of a curb in accordance with one embodiment of the present invention.
Figure 5:
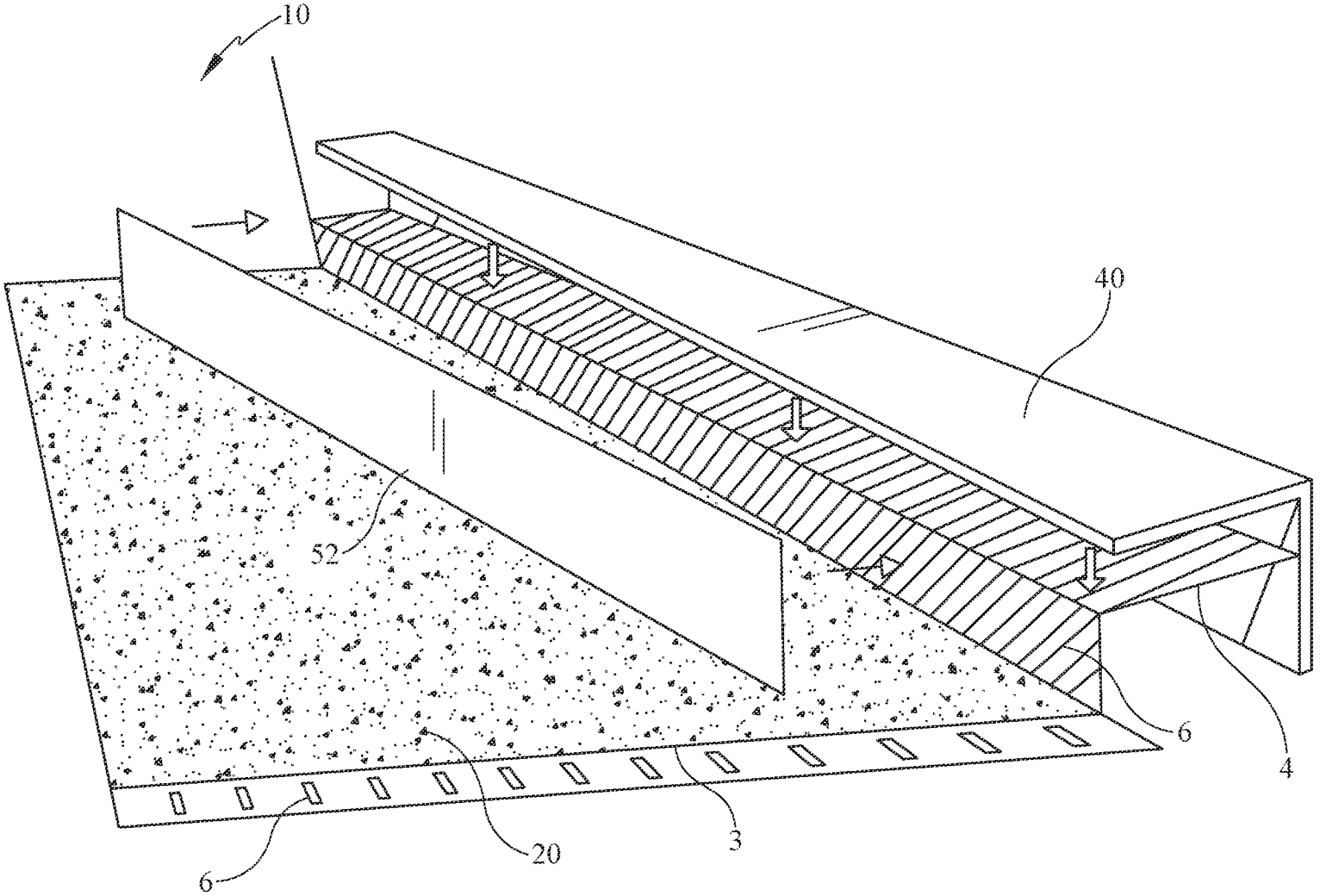
FIG. 5 is a perspective view of a curb and wedge installation in accordance with one embodiment of the present invention.
Figure 6:
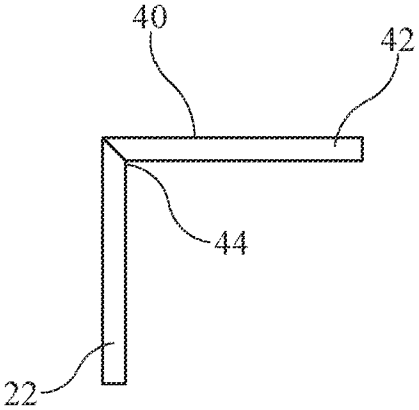
FIG. 6 is a side view of a curb in accordance with one embodiment of the present invention.

In some additional embodiments, and as depicted in FIGS. 4-6, system and apparatus 10 may further include a curb 40 having two sides 42 that are joined to form an interior angle 44 that is shaped to engage curb 4 of shower 1. Curb 40 may be formed of terrazzo material by molding in a similar fashion described herein above with reference to shower pan 20, thereby providing a precast curb 40. In some embodiments curb 40 is formed of terrazzo material to match shower pan 20, and is sized to have a length that substantially covers and engages substrate curb 4, thereby providing a shower curb 40 that matches shower pan 20 for an aesthetically pleasing system 10 and requires little or no cutting or trimming prior to installation. Curb 40 interior angle 44 may be formed to match the exterior angle of curb 40, thereby providing for close engagement of substrate curb 4 and curb 40, ensuring a snug fit to system 10 installation.

Figure 8:
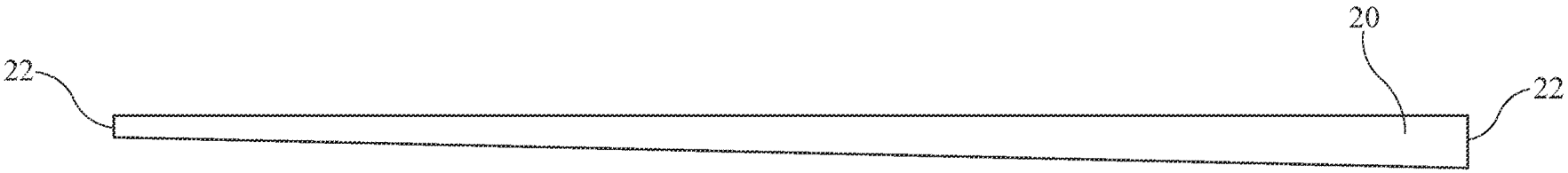
FIG. 8 is a side view of a shower pan in accordance with one embodiment of the present invention.

Additionally, in some exemplary but non-limiting embodiments both shower pan 20 and curb 40 may be comprised of a porcelain material, or other natural stone materials such as marble to provide a selection of varying materials for system 10. In some embodiments various types of natural stone aggregate having a plurality of sizes may be used in conjunction with epoxy resin to produce shower pan 20 and curb 40. In another embodiment as depicted in FIG. 8 shower pan 20 may be slightly sloped from end 22 to end 22. In these embodiments the "lower" end 22 may be oriented towards shower 1 drain 5 when installed, thereby allowing for water to naturally flow towards drain 5. In some embodiments shower 1 floor 3 has a drainage slope so that shower pan 20 may simply be generally flat or planar.

Figure 7:
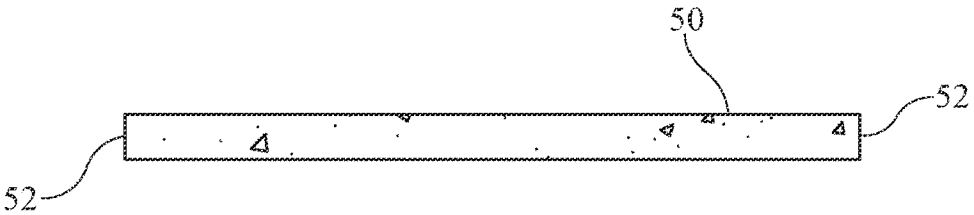
FIG. 7 is an end view of a shower pan in accordance with one embodiment of the present invention.

Additionally, and in accordance with some embodiments as shown in FIG. 7, a wedge or trim piece 50 having a pair of opposed ends 52 may be provided to cover an interior portion of interior curb 4, engaging an edge of curb 40, thereby providing a consistent appearance over the entire shower system 10. Wedge 50 may also be formed of precast terrazzo, as described herein above, or porcelain or natural stone material and polymer resin as desired for a given application.

Figure 3:
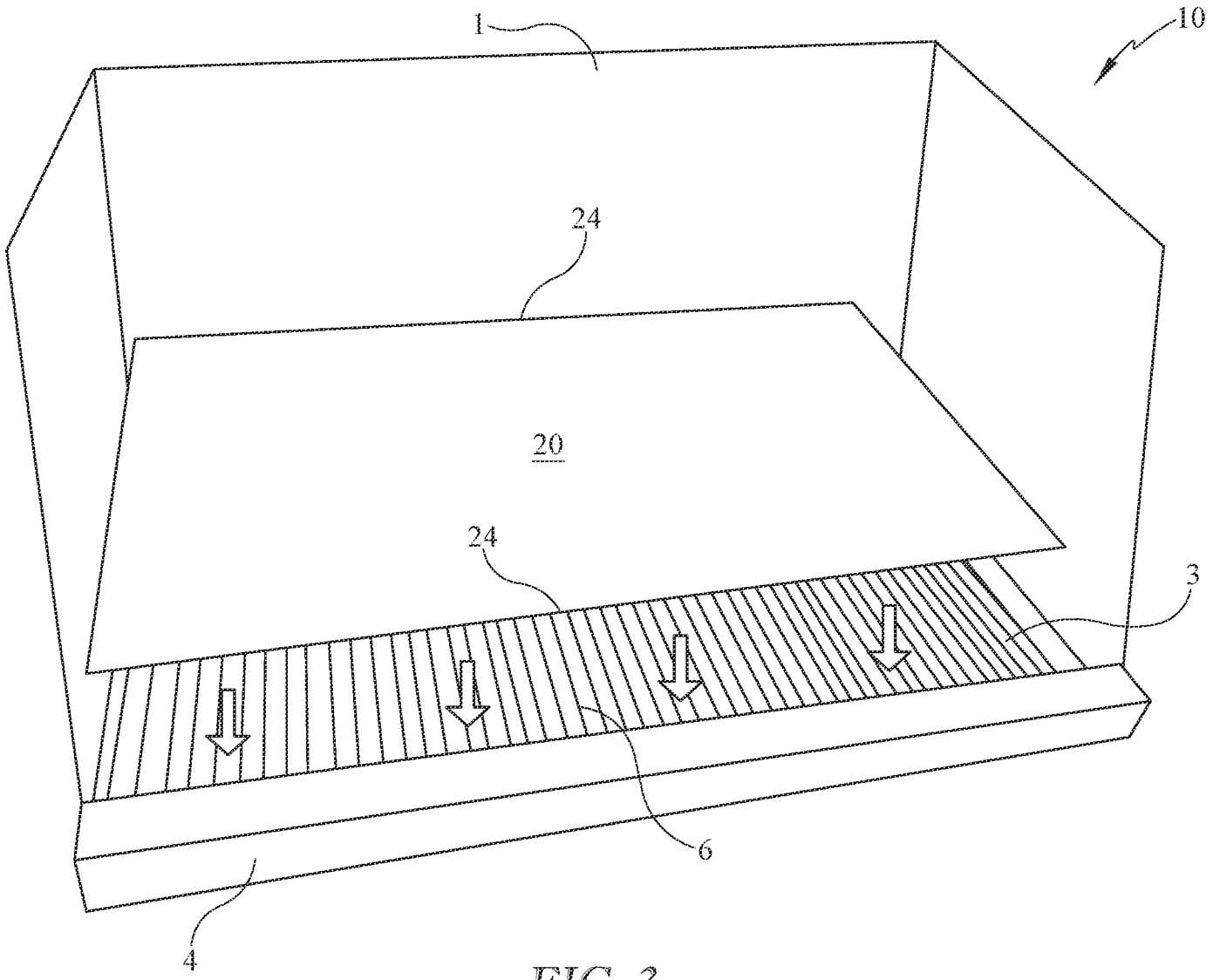
FIG. 3 is a perspective view of a shower pan system in accordance with one embodiment of the present invention.

Referring now to FIGS. 3 and 5, and in some aspects and embodiments system 10 is advantageously and readily installed in the environment of shower 1, first by "dry fitting" shower pan 20 into place on top of shower floor 3 to ensure a proper fit. A medium bed polymer mortar 6 or equivalent adhesive may then be used to skim coat the "back" or "underside" of shower pan 20, and the floor 3. Shower pan 20 may then be positioned on floor 3 and pressed or walked on evenly to distribute mortar 6 between shower pan 20 and floor 3. In embodiments where a linear drain 5 is provided, one end 22 of shower pan 20 is positioned proximate linear drain 5.

In a similar fashion and as best depicted in FIG. 5, curb 40 may be installed by first dry fitting to substrate curb 4 to ensure a proper fit prior to mortaring. Once the correct dry fit is confirmed, curb 4 and interior curb 40 may then be troweled or coated with mortar 6 and curb 40 may then be pressed into place so that interior angle 44 of curb 40 engages curb 4 closely. Finally, wedge 50 may be installed using an application or mortar 6 as described above. Wedge 50 may be appropriately sized to cover an interior portion of curb 4, thereby finishing shower system 10 installation. As is known in the art, the installed system 10 and mortar should be permitted to cure for 24 hours prior to finalizing the installation by caulking and sealing the various joints between floor 20, curb 40 and wedge 50.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," "secured," and "mounted," and variations thereof herein are used broadly and encompass direct and indirect connections, couplings, and mountings. In addition, the terms "secured" and "mounted" and variations thereof are not restricted to physical or mechanical connections or couplings.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

We claim:

1. A shower pan apparatus for covering a shower having a floor and a drain, said apparatus comprising:

a planar floor pan having a length and width sized to cover a predetermined shower floor area;

a curb having an interior angle therein and a length to match that of said floor pan; and a wedge piece having a length to match that of said floor pan; and wherein said floor pan, said curb, and said wedge piece are a single piece formed of terrazzo comprising;

eighty percent by volume of natural stone aggregate having a plurality of sizes;

a predetermined volume of ATF 20 filler; and a predetermined volume of epoxy resin and epoxy resin hardener, wherein said predetermined volume of ATF 20 filler and said predetermined volume of epoxy resin and hardener are twenty percent by volume of said terrazzo.

2. The apparatus as claimed in claim 1 wherein said terrazzo comprises:

size 0, size 1, and size 2 marble aggregate, wherein said size 0 and size 1 white marble aggregate is 80% by volume of the total aggregate and said size 2 white marble is 20% by volume of the total aggregate;

a predetermined volume of ATF 20 filler; and a predetermined volume of epoxy resin and epoxy resin hardener, wherein said predetermined volume of ATF 20 filler and said predetermined volume of epoxy resin and hardener are twenty percent by volume of said terrazzo.

3. The apparatus as claimed in claim 1 comprising:

a foam substrate curb having a length to match said curb and at least one edge shaped to be engaged by said interior angle of said curb.

4. The apparatus as claimed in claim 1 wherein said natural stone aggregate comprises white marble.

5. An apparatus as claimed in claim 1 comprising:

a predetermined quantity of polymer fortified mortar for securing said floor pan, said wedge piece, and said curb.

6. A shower pan apparatus for forming a shower floor having a floor area, a substrate curb having an interior vertical wall, and a drain comprising:

a generally planar single piece terrazzo floor pan having a length and width sized to cover a predetermined shower floor area;

at least one single piece terrazzo curb having a length substantially identical to that of said floor pan, said terrazzo curb having two sides that terminate in an interior angle;

a terrazzo wedge piece sized to cover said vertical wall of said curb; and wherein said floor pan, said terrazzo curb, and said wedge piece are assembled to form said shower pan; and wherein said floor pan, said wedge piece and said curb comprise a predetermined volume of marble having eighty percent by volume size 0 and size 1 marble and twenty percent by volume size 2 marble, a predetermined volume of ATF 20 filler, and a predetermined volume of epoxy resin and epoxy resin hardener.

* * * * *